US006688977B1

(12) United States Patent
Baerlocher et al.

(10) Patent No.: US 6,688,977 B1
(45) Date of Patent: Feb. 10, 2004

(54) GAMING DEVICE WITH BONUS SCHEME HAVING MULTIPLE AWARD LEVELS

(75) Inventors: Anthony J. Baerlocher, Reno, NV (US); Paulina Glavich, Reno, NV (US)

(73) Assignee: IGT, Reno, NV (US)

( * ) Notice: Subject to any disclaimer, the term of this patent is extended or adjusted under 35 U.S.C. 154(b) by 147 days.

(21) Appl. No.: 09/602,140

(22) Filed: Jun. 23, 2000

(51) Int. Cl.[7] ..... A63F 9/24

(52) U.S. Cl. ..... 463/25; 463/20; 273/143 R

(58) Field of Search ..... 463/9–13, 16–20, 463/25, 26–27, 30, 31, 35; 273/273, 236, 237, 292, 138.1, 139, 143 R; 283/903

(56) References Cited

U.S. PATENT DOCUMENTS

| | | | | |
|---|---|---|---|---|
| 4,624,459 | A | 11/1986 | Kaufman | |
| 4,991,848 | A | 2/1991 | Greenwood et al. | |
| 5,397,125 | A | 3/1995 | Adams | |
| 5,449,173 | A | 9/1995 | Thomas et al. | |
| 5,456,465 | A | 10/1995 | Durham | |
| 5,542,669 | A | 8/1996 | Charron et al. | |
| 5,711,525 | A | 1/1998 | Breeding | |
| 5,833,538 | A | 11/1998 | Weiss | |
| 5,967,893 | A | 10/1999 | Lawrence et al. | |
| 6,089,976 | A | 7/2000 | Schneider et al. | |
| 6,102,798 | A | 8/2000 | Bennett | |
| 6,174,235 | B1 * | 1/2001 | Walker et al. | 463/25 |
| 6,190,255 | B1 * | 2/2001 | Thomas et al. | 463/20 |
| 6,203,429 | B1 * | 3/2001 | Demar et al. | 273/143 R |
| 6,315,660 | B1 * | 11/2001 | DeMar et al. | 273/138.2 |
| 6,409,602 | B1 * | 6/2002 | Wiltshire et al. | 463/16 |

FOREIGN PATENT DOCUMENTS

| | | |
|---|---|---|
| EP | 0874337 A1 | 10/1988 |
| EP | 0926645 A2 | 6/1999 |
| EP | 0944030 A2 | 9/1999 |
| EP | 0945837 A2 | 9/1999 |
| EP | 0984408 A2 | 3/2000 |
| EP | 0984409 A2 | 3/2000 |
| WO | WO 0012186 | 3/2000 |

OTHER PUBLICATIONS

Double Bonus Brochure and Game Description published by IGT.

Bally's Circus Advertisement published by Bally's Gaming in 1969.

Jackpot Party Brochures and Articles published by WMS Gaming, Inc. in 1998.

Leopard Sports Brochure published by IGT.

* cited by examiner

*Primary Examiner*—Mark Sager
*Assistant Examiner*—Steven Ashburn
(74) *Attorney, Agent, or Firm*—Bell, Boyd & Lloyd LLC

(57) ABSTRACT

The present invention relates to a bonus scheme for a gaming device which involves multiple award levels for any game scenario having one or more events. Several award levels can be included in a single bonus round. Preferably, various game events are associated with various award levels for a variety of purposes. When an event occurs, the game derives a bonus value from an award level specifically designated for that event. Accordingly, a game can award a player with relatively high or low bonus values, depending upon which event occurs in a game. For example for consolation purposes, the game can award the player with a relatively low bonus value when a bonus round terminates. This type of bonus scheme increases player excitement and enjoyment and generally decreases player frustration.

33 Claims, 8 Drawing Sheets

FIG. 3

52

| 54 BASE AWARD LEVEL | 56 HIGHER AWARD LEVEL ( BASE AWARD X 2) | 58 LOWER AWARD LEVEL ( BASE AWARD X 1/4) | 60 OTHER AWARD LEVEL ( ANY AWARD X N) |
|---|---|---|---|
| 24 | 48 | 6 | N |
| 12 | 24 | 3 | N |
| 8 | 16 | 2 | N |
| 60 | 120 | 15 | N |
| 40 | 80 | 10 | N |
| 16 | 32 | 4 | N |
| 36 | 72 | 9 | N |
| 88 | 176 | 22 | N |

GAMING DEVICE WITH BONUS SCHEME HAVING MULTIPLE AWARD LEVELS

CROSS-REFERENCE TO RELATED APPLICATIONS

This application is related to the following commonly-owned patent applications: "GAMING DEVICE HAVING MULTIPLE AWARD ENHANCING LEVELS," Ser. No. 09/626,720, now U.S. Pat. No. 6,328,649; "GAMING DEVICE HAVING A MULTIPLE SELECTION GROUP BONUS ROUND," Ser. No. 09/605,107, now U.S. Pat. No. 6,511,375, and "GAMING DEVICE HAVING MULTIPLE CHOICE LARGE AWARD BONUS SCHEME," Ser. No. 09/686,284.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device with a bonus scheme having different levels of awards which apply to a single bonus round.

BACKGROUND OF THE INVENTION

In current gaming machines such as slot machines which have bonus schemes, players are able to receive various awards associated with various events in a bonus round. For example, a player may receive a relatively high bonus value for selecting a certain symbol and a relatively low bonus value for selecting another symbol. The bonus value awarded for the same symbol can also vary. For instance, if a player chooses a symbol on one occasion, the game may award a certain bonus value, and if the player chooses the same symbol on another occasion, the game may award a different bonus value. The bonus values which are awarded to a player are predetermined by a computer using known data or by randomly generating data based upon one or more mathematical formulas. For any single symbol or combination of symbols, these techniques often derive bonus values from a single set of possible bonus values. For example, existing gaming devices utilize pay tables which include various sets of values with each set corresponding to a predetermined combination of symbols. European Patent Application No. EP 0 945 837 A2 filed on Mar. 18, 1999 and assigned on its face to WMS Gaming, Inc. discloses a bonus scheme generally of this type.

These types of bonus schemes are unable to award bonus values outside of this set of bonus values. Therefore, they cannot apply different sets or levels of bonus values for different purposes. For instance, these bonus schemes cannot apply different award levels for different levels of success achieved by a player or for a player's failure to achieve a level of success.

To increase player enjoyment and excitement, it is desirable to provide players with gaming devices having new bonus schemes which have multiple award levels applied in a single bonus round.

SUMMARY OF THE INVENTION

The present invention overcomes the above shortcomings by providing a gaming device and method which has multiple award sets or levels, applied alternatively in a single bonus round depending upon the occurrence of certain events in a game.

A program determines the object of the game, how the game is played, and the various events which occur in the game. Programs vary from game to game. Multiple award levels can be included in any game having any program.

An "award level," as used herein, means a predetermined set of bonus values in a bonus round where, relative to another set in the same bonus round, the bonus values are increased or decreased by a numerical multiplying factor. In the present invention, the bonus scheme awards the player with bonus values for the occurrence of certain events. For the different types of events in a game, the game derives bonus values from different award levels. For example, when an event occurs which terminates the bonus round, the game preferably awards the player with a bonus value derived from an award level specifically designated for the end of the bonus round (i.e., a consolation award).

An example game could include four different award levels, where each level includes a set of ten bonus values. The game could include: (a) a base award level for awards for common events; (b) a higher award level for awards provided for certain achievements; (c) a lower award level for consolation when the bonus round terminates (from time to time referred to, herein as "consolation award level"); and (d) another award level for extraordinary events or for any other reason.

Which award level will be applied in connection with a particular event is predetermined and preferably programmed into the computer of the gaming device of the present invention. When the game applies a particular award level, the game randomly generates a value from the award level or retrieves a predetermined bonus value from the award level.

This type of bonus scheme of the present invention provides players with different levels of awards for different circumstances in the same bonus round. When players know that they have the ability to reach higher levels of bonus values, they experience a heightened level of excitement. Also, by awarding players with bonus values (from a lower award level) upon termination of the bonus round, players are less likely to become frustrated if the bonus round terminates, especially when players have gained little or no bonus values.

In one embodiment, the game applies various award levels in connection with a player's choice of various types of symbols. The term, "symbols," as used herein, means representations exhibited by the game in visual, audio or audio-visual form. Preferably, all of the symbols are identical. When a player chooses certain symbols (referred to hereafter as "non-terminating symbols"), the game provides the player with various outcomes, but the game does not terminate the bonus round. When a player chooses other symbols (referred to hereafter as "terminating symbols"), the bonus round terminates.

At the beginning of the bonus round, the game exhibits a predetermined number of symbols. The player chooses a symbol and the game reveals whether the symbol is a terminating or non-terminating symbol. Preferably, the game derives a bonus value from a base award level if the player chooses a relatively common non-terminating symbol. If the player chooses a relatively uncommon non-terminating symbol, the game preferably derives a bonus value from a higher award level. In either case, preferably, the game awards this derived bonus value to the player for the chosen symbol. It should be appreciated, however, that the game can award the player with a derived bonus value for symbols other than the chosen symbol and that the game can use any award level to derive bonus values.

The game then exhibits a bonus message at or near the symbol. Preferably, the bonus message is the numerical representation of the bonus value which the player gained. The game then enables the player to choose another symbol. This process continues until the player chooses a terminating symbol.

When the player chooses a terminating symbol, the game derives a bonus value from a lower award level. Preferably, the game awards the player with one derived bonus value for each non-terminating symbol which the player had not yet chosen. For example, if by default the game awards a player with a bonus value of fifty for choosing non-terminating symbols, the game may award the player with a lower or consolation bonus value of ten for each non-terminating symbol.

The game can also be adapted to award the player with a derived bonus value for terminating symbols or for symbols which the player has already chosen. Preferably, the game exhibits the derived bonus value at or near the symbols for which the game will provide awards. The game sums up all of the bonus values. The game then awards this sum to the player in addition to any other bonus values gained earlier by the player. Finally, the game awards all bonus credits due to the player. At this point, the bonus round terminates.

In another embodiment of the present invention, the symbols are graphical representations of unidentified flying objects (UFO's) or flying saucers. If a player chooses a non-terminating symbol, the game derives a bonus value from a base award level, an increased level or any other award level, except for a lower award level. The chosen flying saucer then wobbles and explodes, and a bonus message appears in place of the flying saucer. Preferably, the bonus message is the bonus value gained by the player, in numerical form.

If the player chooses a terminating symbol, the game derives a bonus value from a lower award level. The flying saucer transforms into a nebula, and a terminating message appears in its place. Preferably, the terminating message is text such as "COLLECT" which informs the player that the bonus round has terminated. Also, the game exhibits a bonus message at each non-terminating symbol which the player had not chosen. This bonus message is the bonus value (preferably, in numerical form) derived from the lower award level. The game then awards bonus values corresponding to each bonus message, and the game awards all other bonus values gained by the player. Finally, the game awards the player with bonus credits which correspond to the awarded bonus values. At this point, the bonus round terminates.

In this embodiment, preferably the game includes a credit window or indicator, bonus window or indicator and pay window or indicator. The bonus indicator displays the running total of bonus values which are displayed at or near a symbol during a bonus round. The credit indicator displays the credits earned by the player which correspond to the bonus values earned by the player. Also, the pay indicator displays the monetary equivalent of the credits gained by the player.

It is therefore an object of the present invention to provide a gaming device with a bonus scheme having multiple award levels which apply to a single bonus round.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 3 is a table of one embodiment of award levels of the present invention;

DETAILED DESCRIPTION OF THE INVENTION

Gaming Device and Electronics

Figure 1:
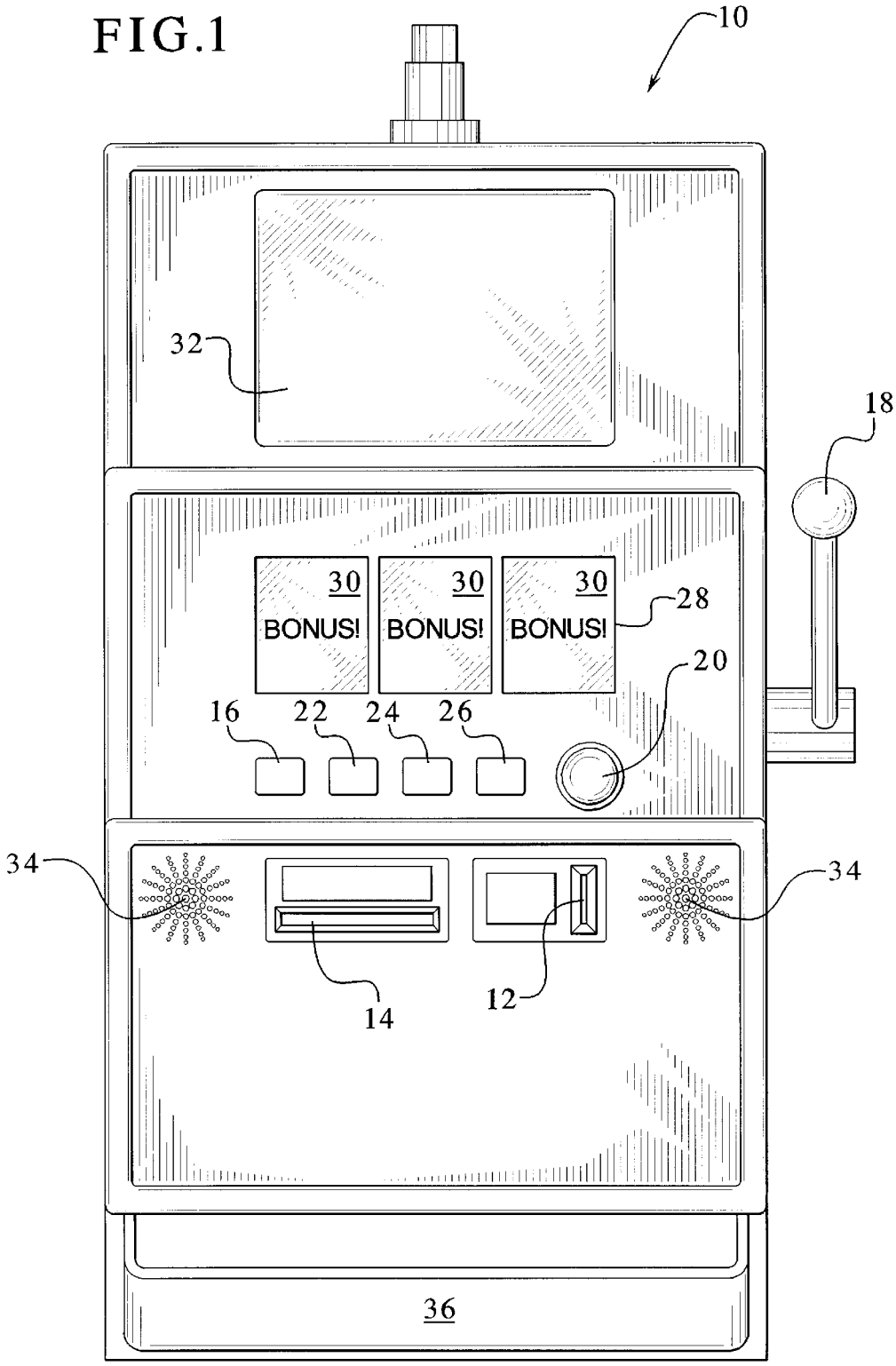
FIG. 1 is a front elevational view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any game such as slot, poker or keno in addition to any of their bonus triggering events which trigger the bonus scheme of the present invention. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at video monitor 32 instead of at display window 28. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out,"the player receives the coins in a coin payout tray 36. The gaming device 10 may employ other payout mechanisms such as credit slips redeemable by a cashier or electronically recordable cards which keep track of the player's credits.

Figure 2:
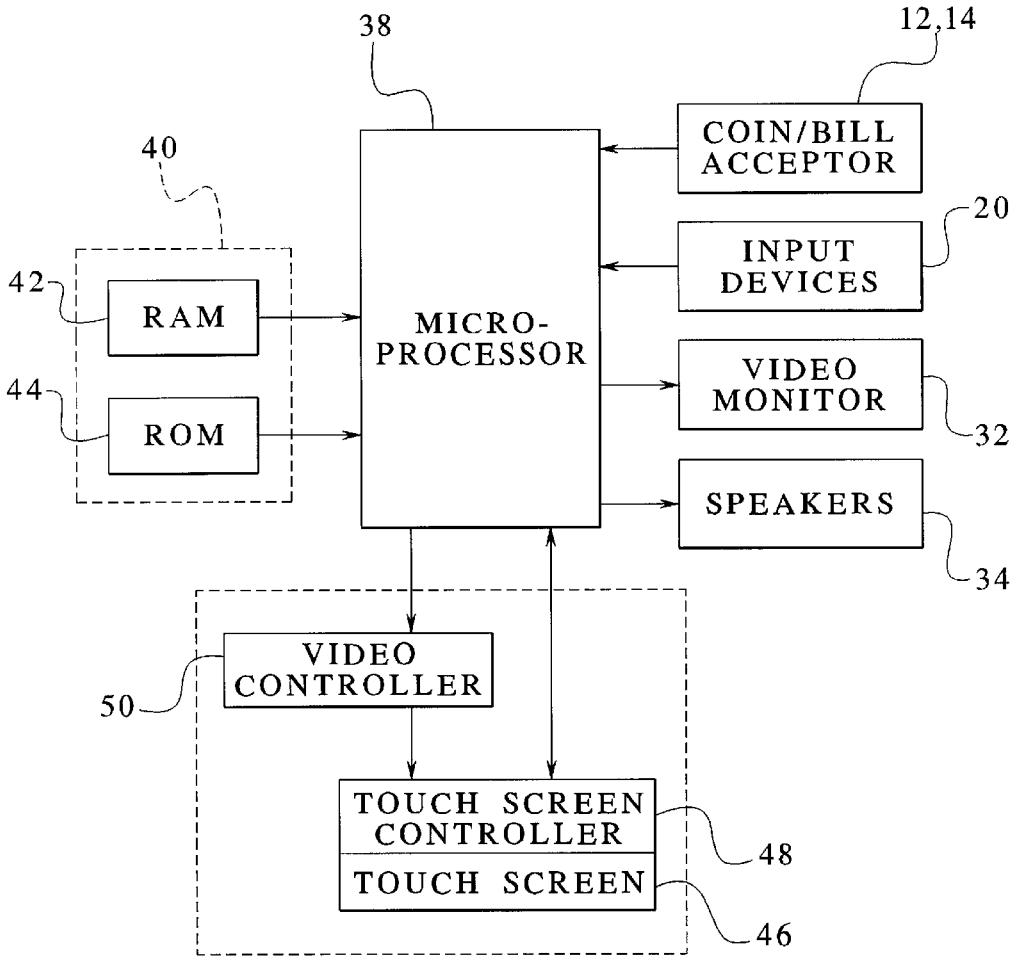
FIG. 2 is a schematic block diagram of the electronic configuration of one embodiment of the gaming device of the present invention.

With respect to electronics, gaming device 10 preferably includes the electronic configuration generally illustrated in FIG. 2, including a processor 38, a memory device 40 for storing program code or other data, a video monitor 32 or other display device (i.e., a liquid crystal display) and at least one input device such as play buttons 20. The processor 38 is preferably a microprocessor or microcontroller-based platform which is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game rules and pay tables.

As illustrated in FIG. 2, the player preferably uses play buttons 20 to input signals into gaming device 10. Furthermore, it is preferable that touch screen 46 and an associated touch screen controller 48 are used instead of a conventional video monitor 32. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer."

With reference to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on the display window 28. The gaming device 10 also includes a display device such as a video monitor 32 shown in FIG. 1 enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Bonus Scheme

If a player achieves a bonus triggering or qualifying condition while playing the game, the gaming device 10 automatically begins the bonus round of the present invention. At the beginning of the bonus round, the game exhibits or displays one or more symbols, sounds, indicators, selections, visual or audio representations or other graphical representations. The bonus scheme may involve a variety of game scenarios which involve awarding bonus values to a player upon the occurrence of certain events. The computer of the gaming device determines what a game exhibits or displays, game scenarios, the object of the game, how the game is played and the various events which occur in the game.

The bonus values are derived from various award levels which are included in the bonus scheme. The award levels are predetermined and preferably programmed into the computer. Furthermore, the relationship between certain events and certain award levels is predetermined and preferably programmed into the computer. This relationship determines which award levels are used in relation to certain events.

A variety of award levels can be used for a variety of purposes. For illustrative purposes only, four award levels are shown in award level table 52 in FIG. 3. Each award level includes ten bonus values in this example. The computer uses base award level 54 to derive bonus values for relatively common events, that is, events which had a higher probability of occurrence than any other game event. Typically, the computer would use base award level 54 to derive bonus values for the majority of the bonus values awarded in a game. The bonus values in a base award level 54 are the reference bonus values. The bonus values in other award levels are preferably (but not necessarily) calculated by multiplying these reference bonus values by a numerical multiplying factor.

The computer uses higher award level 56 to derive bonus values for less frequent events, that is, events which have a lower probability of occurrence than any other game event. As shown in FIG. 3, higher award level 56 includes a multiplying factor greater than one such that the bonus values in the higher award level 56 are greater than the bonus values in base award level 54. In the example shown in FIG. 3, the bonus values in the higher award level 56 are double the bonus values in base award level 54. The computer uses a lower award level 58 to derive bonus values for events which cause the termination of a bonus round or for other events which decrease the player's chance of success. Preferably, this type of award level is for consolation purposes. Lower award level 58 includes a multiplying factor which is less than one. Therefore, the bonus values in a lower award level 58 are a fraction of the bonus values in the base award level 54.

Finally, any other award level 60, using any multiplying factor, can be used to derive bonus values for any other purpose of a particular game. All of the bonus values and multiplying factors set forth in FIG. 3 are used herein merely for illustrative purposes. It should be appreciated that any magnitude of bonus values, any number of bonus values and any multiplying factor can be included in any particular award level. Furthermore, it should be appreciated that any number of award levels can be included in a game.

In operation, when an event occurs which warrants a bonus value, the computer derives the bonus value from a pre-determined award level. The particular bonus value retrieved from an award level can be pre-determined. Alternatively, it can be the result of a random generation technique, wherein the bonus values in an award level are randomized and one bonus value is generated. Once the computer derives a bonus value from an award level, the game awards it to the player. After a player receives this award, the game may enable the player to continue in the bonus round with the opportunity to gain additional bonus values. With reference to FIG. 3, when certain relatively common events occur, the game can use base award level 54 to generate bonus values. Also, when certain achievement-based events or other events occur, the game can use higher award level 56 to derive bonus values. For instance, if a player makes a relatively uncommon achievement, the game can use the higher award level 56.

Eventually, an event will occur which causes the bonus round to terminate. Preferably, when this type of an event occurs, the game will derive a bonus value from a lower award level 58. The game will then award the derived bonus value to the player which will serve as a consolation award. Finally, the bonus round will terminate.

The bonus scheme of the present invention provides different bonus award levels for different circumstances which might occur in a single bonus round. Consequently, a game can award bonus values from different award levels to a player. This type of bonus scheme enables the game to award the player with various award levels designated for various purposes (i.e., achievement or consolation). The present invention accordingly increases player excitement due to the possibility of earning bonus values from relatively higher award levels. The present invention also decreases player frustration by awarding the player with a consolation bonus value. This is especially important when a player is eliminated from the bonus round when having gained little or no bonus value.

Figure 4:
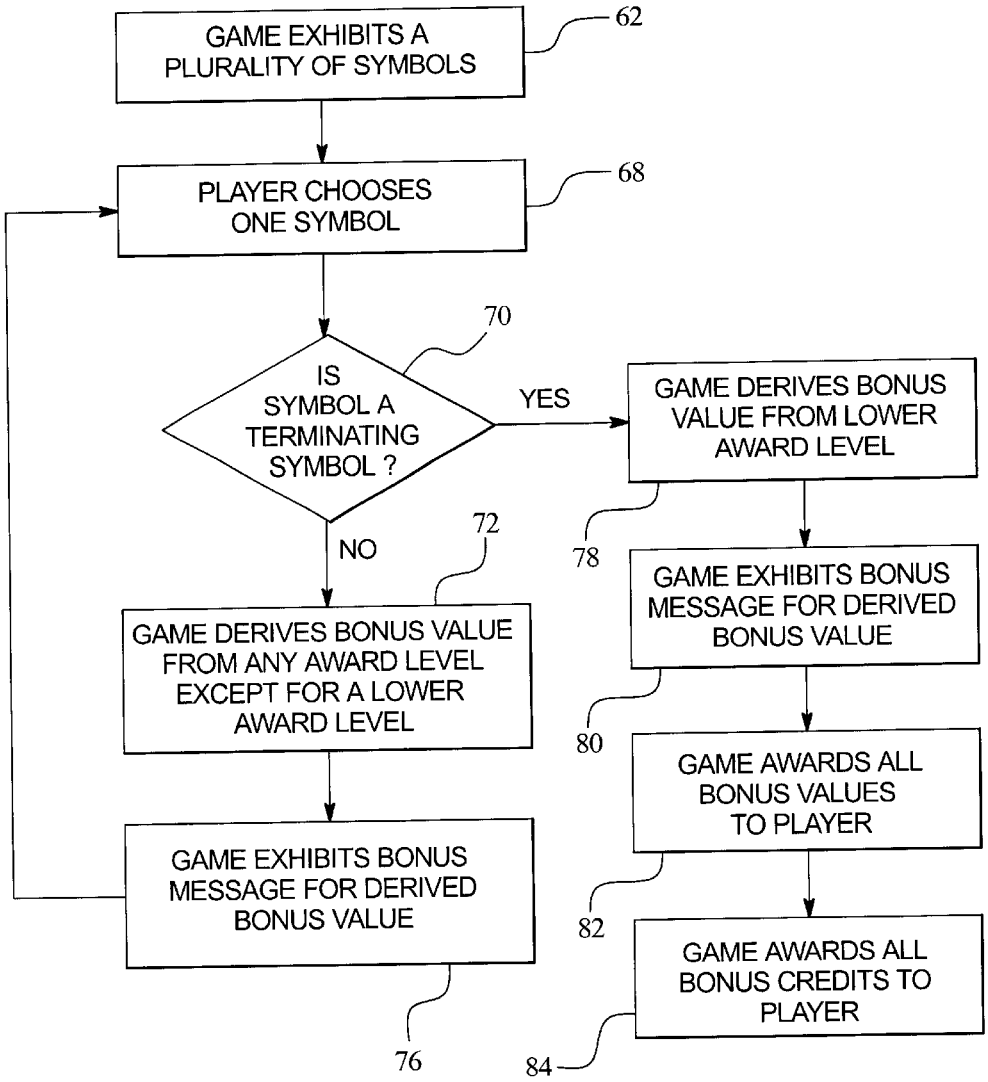
FIG. 4 is a flow diagram of one embodiment of the bonus scheme of the present invention.
Figure 5:
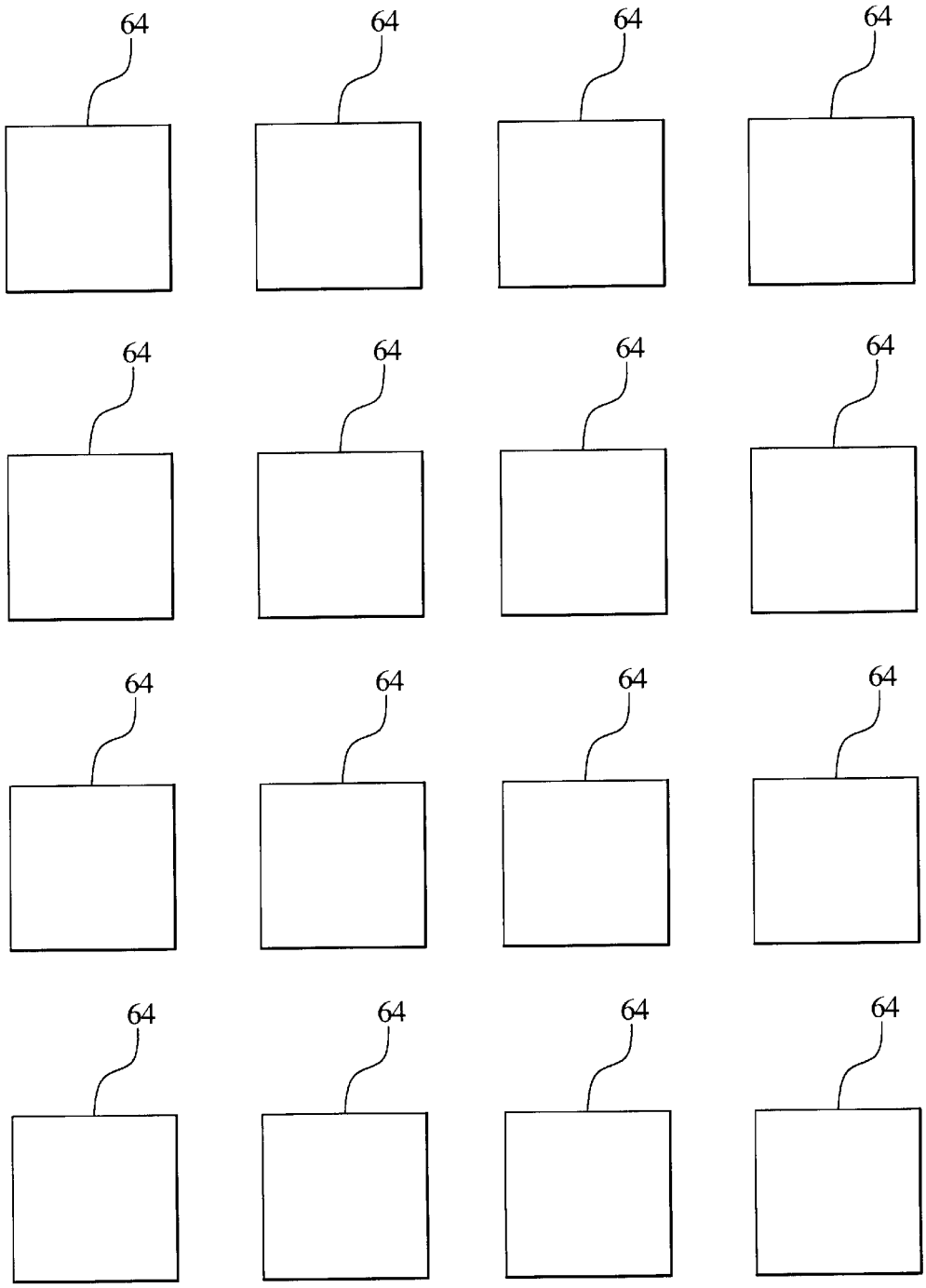
FIG. 5 is a top plan view of the symbols in the embodiment of FIG. 4 of the present invention prior to the player making any selections.

In one preferred embodiment of the present invention, the game exhibits a plurality of symbols as indicated by block 62 in FIG. 4. Preferably, all of the symbols are identical. This plurality of symbols includes one or more masked non-terminating symbols 64 and one or more masked terminating symbols 66 as illustrated in FIG. 5. Next, as indicated by block 68 in FIG. 4, the player chooses one symbol. As indicated by diamond 70 and block 72 in FIG. 4, if the chosen symbol is a non-terminating symbol 64, the game then derives a bonus value from any award level except for a lower award level 58. The award level utilized could be a base level 54, a higher award level 56 or any other award level 60. Preferably, if the chosen symbol is relatively common, the game uses a base award level 54 and if the chosen symbol is relatively uncommon, the game uses a higher award level 56. The game preferably awards the player with the derived bonus value for the chosen non-terminating symbol 64. However, it should be appreciated that the present invention can be adapted to award the player with the derived bonus value for any or all exhibited symbols.

Figure 6:
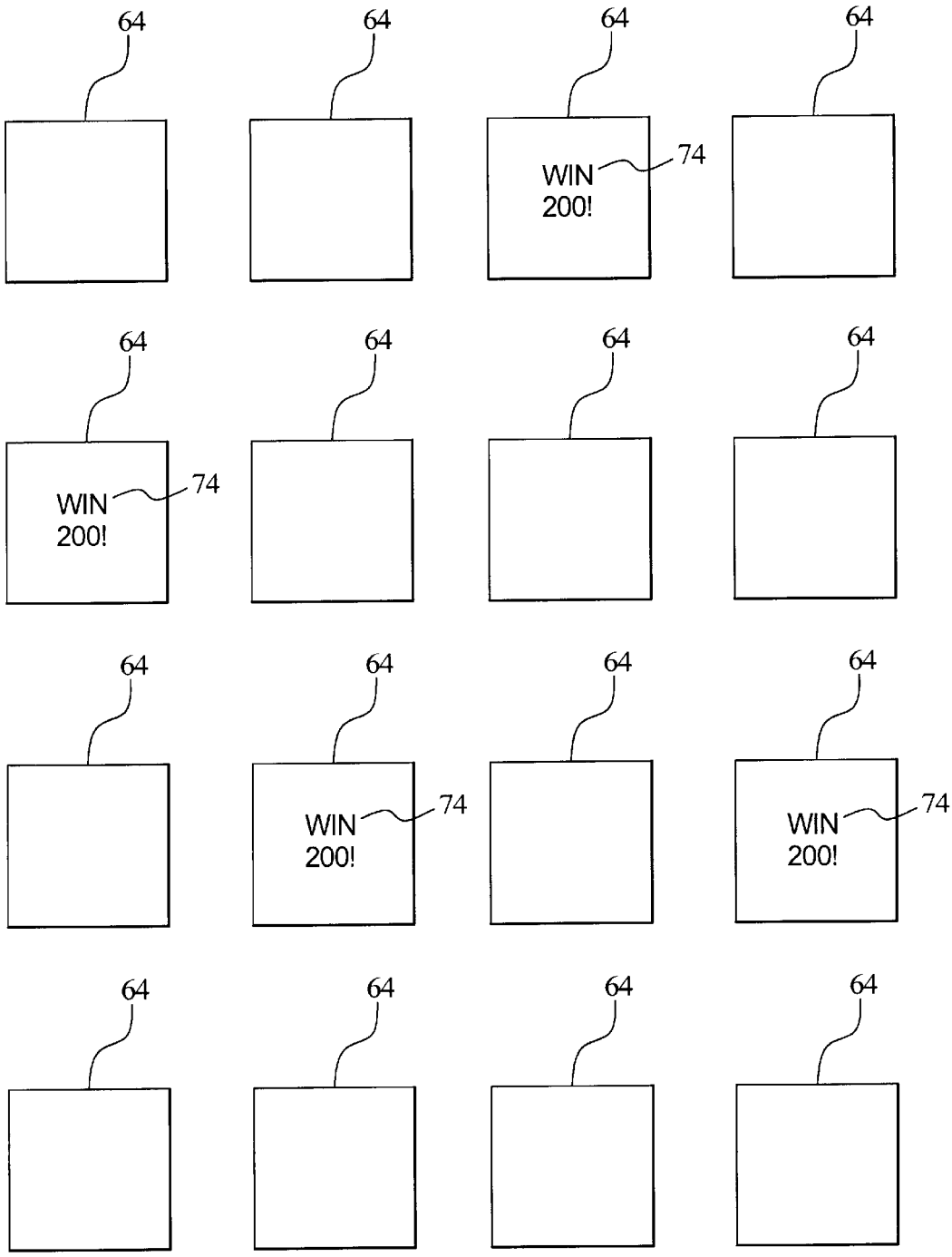
FIG. 6 is a top plan view of the symbols and messages in the embodiment of FIG. 4 of the present invention after the player has made four selections.
Figure 7:
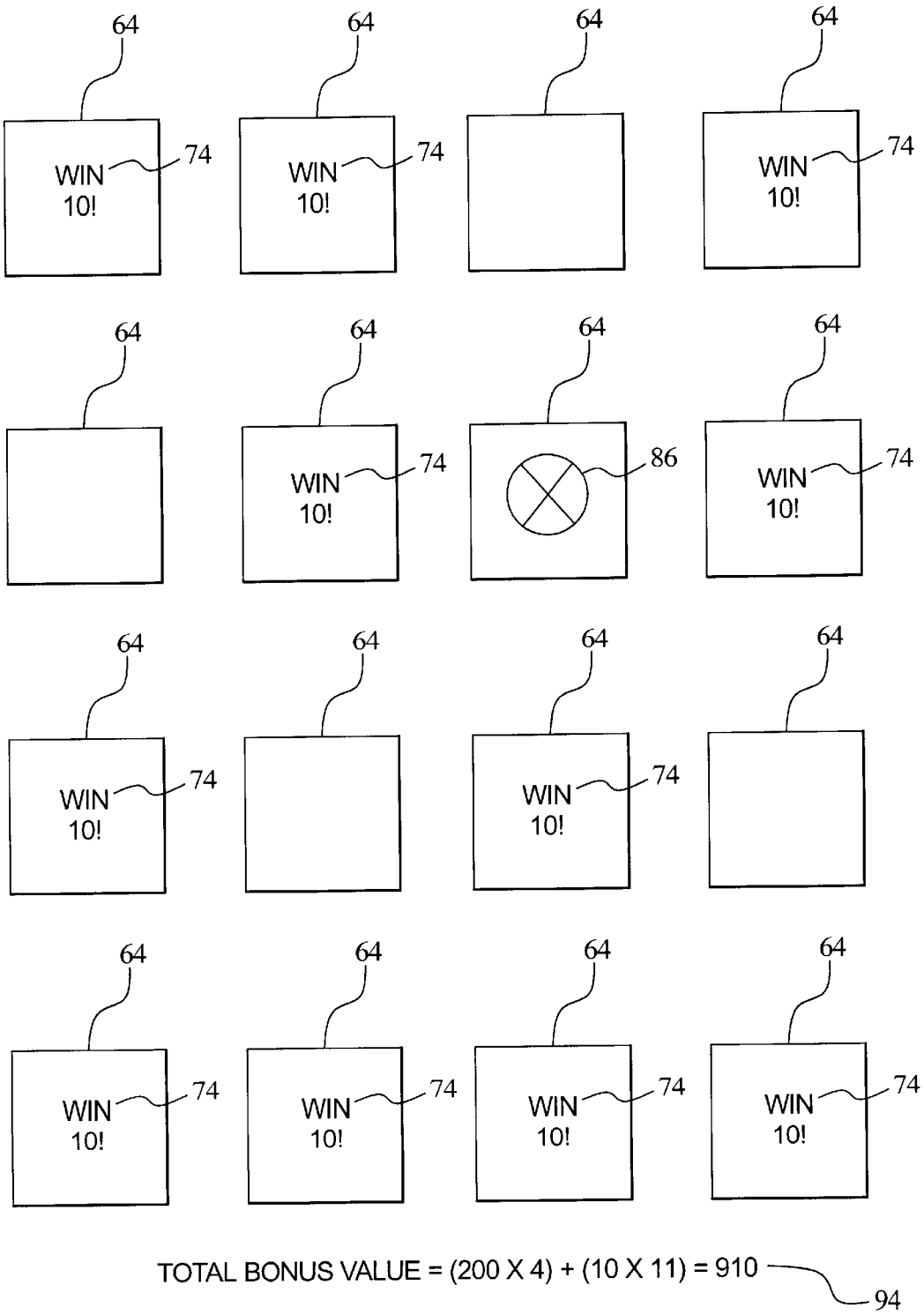
FIG. 7 is a top plan view of the symbols and messages of the embodiment of FIG. 4 of the present invention upon termination of the bonus round.

As shown in FIGS. 6 and 7, the game preferably displays a bonus message 74 at or near the chosen symbol. A bonus message 74 is any audio, visual, or audio-visual representation used to inform a player of the amount of the bonus value awarded to the player. Preferably, the bonus message 74 is a numerical representation of a bonus value (i.e., numerals). After the game exhibits the bonus message 74, as indicated by block 76, the game enables the player to choose another symbol. This process repeats itself until the player ultimately chooses a terminating symbol 66.

When the player chooses a terminating symbol 66, the game derives a bonus value from a lower award level 58, as indicated by diamond 70 and block 78. Preferably, the game awards the player with the same derived bonus value for each non-terminating symbol 64 which the player had not chosen. However, it should be appreciated that the game can be adapted to award the derived bonus value for the terminating symbol 66 itself or for any other symbol, whether or not it has been previously chosen and whether it is a non-terminating symbol 64 or a terminating symbol 66. As indicated by block 80, the game exhibits a bonus message 74 for the derived bonus value. Preferably, the game exhibits this bonus message 74 at or near each symbol for which the game will award the player with a bonus value. As indicated by block 82 in FIG. 4, the game awards the player with all bonus values which the player gained in the bonus round. Finally, as indicated by block 84, the game awards all bonus credits due to the player.

An example bonus round of the first preferred embodiment of the present invention is further shown in FIGS. 5 through 7. In the first screen illustrated in FIG. 5, the game exhibits sixteen symbols 64. The nature of a symbol (whether it is terminating or non-terminating) is not disclosed to the player. In one embodiment, all of the symbols are identical as illustrated in FIG. 5. In another embodiment, the symbols may vary.

In this example bonus round, the player chooses the non-terminating symbol 64 located in the first column and second row of the symbols, as shown in FIG. 6. After the player selects this non-terminating symbol 64, the game derives the bonus value from an award level other than a lower award level 58. For illustrative purposes, this derived value is 200 points. Next, the game exhibits bonus message 74 at this non-terminating symbol 64. Preferably this bonus message 74 displays the derived bonus value in numerical form, as illustrated in FIG. 6, such as the message "WIN 200!".

The game next enables the player to choose another symbol. In this example bonus round, the player's next choices are the non-terminating symbols 66 shown at the following locations in FIG. 6: (a) second column and third row; (b) third column and first row; and (c) fourth column and third row. The game then exhibits bonus messages 74 at the chosen symbols, as illustrated in FIG. 6.

In reference to FIG. 7, finally the player chooses the terminating symbol 66 which is located at the third column and second row. After choosing terminating symbol 66, preferably the game exhibits a terminating message 86, represented by a circled "X" at or near the terminating symbol 66. The terminating message 86 is any information (in audio, visual or audio-visual form) provided to the player which indicates that the bonus round is terminated. The game then derives a bonus value from a consolation or lower award level 58. In this case, as an illustration, this value is 10 points. The game exhibits a bonus message 74, such as "WIN 10!" at or near all non-terminating symbols 64 which the player had not already chosen. It should be appreciated, however that the game can exhibit a bonus message 74 at any symbol, including the terminating symbol 66 itself. It should also be appreciated the game could include more than one terminating symbol 66.

After the game exhibits this bonus value at the appropriate symbols, the game awards the player with all bonus values which are exhibited during the bonus round. This would include all bonus values derived from lower award levels 58 and all bonus values derived from all other award levels. In this example, the total bonus value amount is nine hundred and ten points ((200×4)+(10×11)). Finally, the game awards the player with bonus credits which correspond to the earned bonus values.

Figure 8:
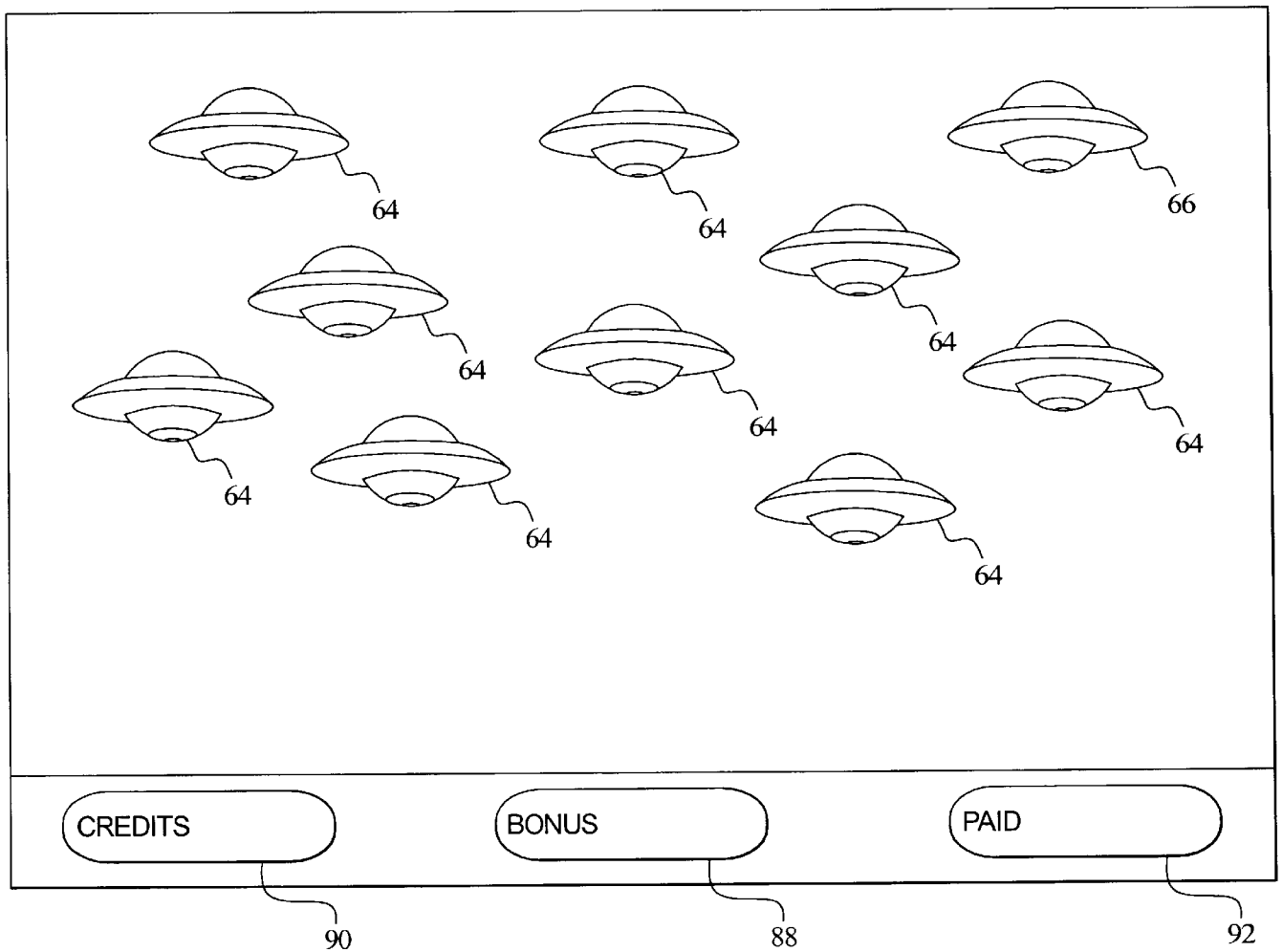
FIG. 8 is a top plan view of the symbols provided by another embodiment of the present invention.

In another embodiment of the present invention, the symbols are represented by unidentified flying objects (UFOs) or flying saucers, as shown in FIG. 8. Nine of the flying saucers are non-terminating symbols 64 and one of the flying saucers is a terminating symbol 66, as shown in FIG. 8. Preferably, all of the flying saucers are identical.

When a player selects a non-terminating symbol 64, the chosen flying saucer wobbles and then explodes. The game then derives the bonus value from a lower award level 58, and this bonus value appears in the place of the exploding flying saucer. Preferably, the bonus value is shown in numerical form. This bonus value is displayed at bonus window or bonus indicator 88 shown in FIG. 8. Bonus indicator 88 maintains a running total of accumulated bonus values during the bonus round.

This entire process continues as long as the player continues to choose non-terminating symbols 64. When a player chooses a terminating symbol 66, the terminating flying saucer transforms into a nebula. This transformation is the terminating message 86.

The computer then derives a bonus value from a lower award level 58 and exhibits this bonus value at all non-terminating symbols 64 which the player had not already chosen. The game sums up these bonus values and displays them at bonus indicator 88. Next, the game displays at credit window or credit indicator 90 the bonus credits which correspond to the bonus values earned by the player. Finally, at pay window or pay indicator 92, the game displays the monetary equivalent of the bonus credits earned by the player.

The bonus scheme of the present invention enables games to be designed with a variety of award levels associated with a variety of game events. When a certain event occurs, the computer can use an award level specifically designated for such an event in order to derive a bonus value for a player. For instance, one level can be used for a certain achievement, another level can be used for another achievement and a different level can be used for failure or termination of the bonus round. This type of award design increases the sophistication of gaming device bonus schemes, increases player enjoyment and decreases player dissatisfaction.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device comprising:

a plurality of symbols including at least one non-terminating symbol and at least one terminating symbol;

a non-consolation award level including a plurality of values;

a consolation award level including a plurality of values which differ from said plurality of values in said non-consolation award level;

a display device adapted to exhibit the symbols to a player; and a processor in communication with said display device, said processor enabling the player to choose at least one of said plurality of symbols exhibited by said display device, wherein upon the player choosing the non-terminating symbol, said processor selects at least one value from said plurality of values in the non-consolation award level and awards the player with said value from the non-consolation award level, and wherein upon the player choosing the terminating symbol, said processor selects at least one value from said plurality of values in the consolation award level and provides the player an award based on the selected value from the consolation award level and the number of non-terminating symbols not chosen.

2. The gaming device of claim 1, wherein said processor provides the player with an award based on a plurality of values from said consolation award level and the number of non-terminating symbols not chosen when the player chooses said terminating symbol.

3. The gaming device of claim 2, wherein each non-consolation value is associated with a non-terminating symbol.

4. The gaming device of claim 1, wherein the values in the non-consolation award level are higher than the values in the consolation award level.

5. A method for operating a gaming device, said method comprising the steps of:

(a) providing a plurality of symbols, including at least one non-terminating symbol and at least one terminating symbol;

(b) causing at least one symbol to be chosen by a player;

(c) selecting at least one value from a plurality of values included in a non-consolation award level and awarding the player with said value if said non-terminatinq symbol is chosen; and (d) selecting at least one value from a plurality of values included in a consolation award level, and providing the player an award based on the selected value from the consolation award level and the number of non-terminating symbols not chosen if said terminating symbol is chosen.

6. The method of claim 5, which includes the step of operating the gaming device through a data network.

7. The method of claim 6, wherein the data network is an internet.

8. The method of claim 5, wherein computer instructions for implementing steps (a) to (d) are stored in a memory device.

9. A gaming device comprising:

a plurality of symbols including at least one non-terminating symbol and at least one terminating symbol;

at least two award levels, wherein each award level includes a different plurality of values; and a display device adapted to exhibit the symbols to a player, whereby when the player selects one of said non-terminating symbols the game selects at least one value from one of said award levels and provides the player with said value, and when the player selects one of said terminating symbols, the game selects at least one value from another one of said award levels and provides the player an award based on the selected value from said other award level and the number of non-terminating symbols not selected.

10. The gaming device of claim 9, wherein when the player selects one of said terminating symbols, the game selects a plurality of values from another one of said award levels.

11. A gaming device comprising:

a plurality of symbols including at least one non-terminating symbol and at least one terminating symbol;

at least one non-consolation award level;

at least one consolation award level;

at least one display device adapted to exhibit the symbols to a player; and a processor in communication with said display device, said processor operable to enable the player to choose at least one symbol exhibited by said display device, wherein upon the player choosing the non-terminating symbol, said processor selects at least one value from the non-consolation award level and awards the player with said value from the non-consolation award level, and wherein upon the player choosing the terminating symbol, said processor selects a value and awards the player said value from the consolation award level a number of times based on the number of non-terminating symbols which the player has not selected.

12. The gaming device of claim 11, wherein said processor randomly selects the values from said non-consolation award level and said consolation award level.

13. A gaming device comprising:

a plurality of symbols including at least one non-terminating symbol and at least one terminating symbol;

at least one non-consolation award level;

at least one consolation award level;

at least one display device adapted to exhibit the symbols to a player; and a processor in communication with said display device, said processor operable to enable the player to choose at least one symbol exhibited by said display device, wherein upon the player choosing the non-terminating symbol, said processor selects at least one value from the non-consolation award level and awards the player with said value from the non-consolation award level, and wherein upon the player choosing the terminating symbol, said processor selects from the consolation award level a number of values based on the number of non-terminating symbols which the player has not chosen and awards the player said values from the consolation award level.

14. The gaming device of claim 13, wherein said processor randomly selects the values from said non-consolation award level and said consolation award level.

15. A gaming device comprising:

a plurality of symbols including at least one non-terminating symbol and at least one terminating symbol;

at least two award levels, wherein each award level including a different plurality of values;

display device adapted to exhibit the symbols to a player; and a processor in communication with said display device, said processor enabling the player to choose at least one of said plurality of symbols exhibited by said display device, wherein upon the player choosing the non-terminating symbol, said processor selects at least one value from one of said award levels and awards the player with said value and wherein upon the player choosing the terminating symbol, said processor selects at least one value from another one of said award levels and provides the player an award based on said selected value from the other award level and the number of non-terminating symbols not selected.

16. A method of operating a gaming device, said method comprising the steps of:

(a) providing a plurality of symbols, including at least one non-terminating symbol and at least one terminating symbol;

(b) causing at least one symbol to be chosen by a player;

(c) when said non-terminating symbol is chosen, deriving at least one value from a non-consolation award level and awarding the player said value from the non-consolation award level; and (d) when said terminating symbol is chosen, deriving a value from a consolation award level and awarding the player said value a number of times equal to the number of non-terminating symbols which the player has not selected.

17. The method of claim 16, wherein the values from said non-consolation award level and said consolation award level are randomly selected.

18. The method of claim 16, which includes the step of operating the gaming device through a data network.

19. The method of claim 18, wherein the data network is an internet.

20. The method of claim 16, wherein computer instructions for implementing steps (a) to (d) are stored in a memory device.

21. A method of operating a gaming device, said method comprising the steps of:

(a) providing a plurality of symbols, including at least one non-terminating symbol and at least one terminating symbol;

(b) causing at least one symbol to be chosen by a player;

(c) when said non-terminating symbol is chosen, deriving at least one value from a non-consolation award level and awarding the player said value from the non-consolation award level; and (d) when said terminating symbol is chosen, deriving a number of values from a consolation award level equal to the number of non-terminating symbols which the player has not selected and awarding the player said number of values from the consolation award level.

22. The method of claim 21, wherein the values from said non-consolation award level and from said consolation award level are randomly selected.

23. The method of claim 21, which includes the step of operating,the gaming device through a data network.

24. The method of claim 23, wherein the data network is an internet.

25. The method of claim 21, wherein computer instructions for implementing steps (a) to (d) are stored in a memory device.

26. A method of operating a gaming device, said method comprising the steps of:

(a) providing a plurality of symbols, including at least one non-terminating symbol and at least one terminating symbol;

(b) causing at least one symbol to be chosen by a player;

(c) selecting at least one value from one of at least two award levels and providing the player said value if said non-terminatinq symbol is chosen; and (d) selecting at least one value from another one of said award levels and providing the player an award based on said selected value from the other award level and the number of non-terminating symbols not selected if said terminating symbol is chosen.

27. The method of claim 26, which includes the step of operating the gaming device through a data network.

28. The method of claim 27, wherein the data network is an internet.

29. The method of claim 26, wherein computer instructions for implementing steps (a) to (d) are stored in a memory device.

30. A gaming device comprising:

a primary wagering game operable upon a wager by a player;

a plurality of symbols including at least one non-terminating symbol and at least one terminating symbol;

at least one non-consolation award level;

at least one consolation award level;

a triggering event in said primary wagering game wherein after the occurrence of said triggering event the player is enabled to choose at least one symbol, at least one value from the non-consolation award level is selected and awarded to the player if said non-terminating symbol is chosen and a value from the consolation award level is selected and awarded to the player a number of times based on the number of non-terminating symbols which the player has not chosen if said terminating symbol is chosen.

31. The gaming device of claim 30, wherein said values from said non-consolation award level and said consolation award level are randomly selected.

32. A gaming device comprising:

a primary wagering game operable upon a wager by a player;

a plurality of symbols including at least one non-terminating symbol and at least one terminating symbol;

at least one non-consolation award level;

at least one consolation award level;

a triggering event in said primary wagering game wherein after the occurrence of said triggering event the player is enabled to choose at least one symbol, at least one value from the non-consolation award level is selected and awarded to the player if said non-terminating symbol is chosen and a number of values based on the number of non-terminating symbols which the player has not chosen are selected from the consolation award level and awarded to the player if said terminating symbol is chosen.

33. The gaming device of claim 32, wherein said values from said non-consolation award level and said consolation award level are randomly selected.

* * * * *